US009463357B2

(12) United States Patent
Ok

(10) Patent No.: US 9,463,357 B2
(45) Date of Patent: Oct. 11, 2016

(54) VIRTUAL GOLF SIMULATION APPARATUS PROVIDING PUTTING GUIDE

(75) Inventor: Jae Yoon Ok, Goyang-Si (KR)

(73) Assignee: GOLFZON CO., LTD., Daejeon (KR)

( * ) Notice: Subject to any disclaimer, the term of this patent is extended or adjusted under 35 U.S.C. 154(b) by 646 days.

(21) Appl. No.: 13/520,030

(22) PCT Filed: Dec. 30, 2010

(86) PCT No.: PCT/KR2010/009553

§ 371 (c)(1),
(2), (4) Date: Jun. 29, 2012

(87) PCT Pub. No.: WO2011/081471

PCT Pub. Date: Jul. 7, 2011

(65) Prior Publication Data

US 2012/0276965 A1 Nov. 1, 2012

(30) Foreign Application Priority Data

Dec. 31, 2009 (KR) ..... 10-2009-0136259

(51) Int. Cl.
*A63B 24/00* (2006.01)
*A63B 71/06* (2006.01)
*A63B 71/04* (2006.01)

(52) U.S. Cl.
CPC ..... *A63B 24/0021* (2013.01); *A63B 71/0622* (2013.01); *A63B 71/04* (2013.01); *A63B 2024/0043* (2013.01); *A63B 2102/32* (2015.10)

(58) Field of Classification Search
CPC ..... A63B 24/0021; A63B 71/0622; A63B 2024/0043; A63B 71/04; A63B 2243/0029
USPC ..... 463/2, 3; 473/156, 222
See application file for complete search history.

(56) References Cited

U.S. PATENT DOCUMENTS 5,319,548 A * 6/1994 Germain ..... A63B 71/06 273/DIG. 26
5,507,485 A * 4/1996 Fisher ..... A63B 69/36 473/131

(Continued)

FOREIGN PATENT DOCUMENTS

JP 10-151277 A 6/1998
KR 10-0434599 B1 6/2003

(Continued)

OTHER PUBLICATIONS

Tiger Woods PGA Tour 07. Wikipedia. Online. Accessed via the Internet Accessed Sep. 14, 2015. <URL: https://en.wikipedia.org/wiki/Tiger_Woods_PGA_Tour_07>.*

(Continued)

*Primary Examiner* — Pierre E Elisca
*Assistant Examiner* — Carl V Larsen
(74) *Attorney, Agent, or Firm* — Paratus Law Group, PLLC

(57) ABSTRACT

Disclosed herein are a virtual golf simulation apparatus and method that is capable of performing virtual golf simulation as if a golfer is frequently guided by a caddie during a round of golf in a real golf course and, in particular, the caddie reads the lie of a green and guides a putting direction when the golfer putts a golf ball to provide contents provided through the virtual golf simulation in a more active golfer-oriented form, thereby improving user convenience and inducing interest in virtual golf. The virtual golf simulation apparatus includes an image processing means for displaying an image of a virtual green and topographical information of the virtual green, a simulation means for performing golf simulation on the green, and a putting guide display means for displaying a putting guide which confirms the topographical information of the green on all or some of the area between a golf ball and a hole cup on the green in a virtual golf course to suggest a direction in which a user is to putt the golf ball.

16 Claims, 6 Drawing Sheets

(56) References Cited

U.S. PATENT DOCUMENTS

| | | | | |
|---|---|---|---|---|
| 6,217,444 | B1 * | 4/2001 | Kataoka | A63F 13/10 434/252 |
| 6,296,579 | B1 * | 10/2001 | Robinson | A63B 57/00 473/407 |
| 6,650,952 | B1 | 11/2003 | Kunzle et al. | |
| 6,802,772 | B1 * | 10/2004 | Kunzle et al. | 463/2 |
| 7,566,275 | B2 * | 7/2009 | Yun | 473/152 |
| 7,847,808 | B2 * | 12/2010 | Cheng et al. | 345/634 |
| 8,142,301 | B2 * | 3/2012 | Haag et al. | 473/222 |
| 2002/0049101 | A1 * | 4/2002 | Robinson | A63B 57/00 473/407 |
| 2003/0040349 | A1 * | 2/2003 | Imaeda et al. | 463/3 |

FOREIGN PATENT DOCUMENTS

| | | |
|---|---|---|
| KR | 10-2009-0105279 A | 10/2009 |
| WO | WO 2009-145463 | 12/2009 |

OTHER PUBLICATIONS

Tiger Woods PGA Tour 07 Review. Gamepost.com. Online. Oct. 13, 2007. Accessed via the Interent. Accessed Sep. 14, 2015. <URL: http://www.gamespot.com/reviews/tiger-woods-pga-tour-07-review/1900-6159847/>.*

Tiger Woods PGA Tour 07 Nintendo Wii Video—Long Putting. Youtube.com. Online. Accessed via the Interent. Accessed Sep. 14, 2015. <URL: https://www.youtube.com/watch?v=Y06ZV-jic-g>.*

A question on caddies. Hotshotsgolf.com. Online. Jun. 7, 2009. Accessed via the Interent. Accessed Sep. 14, 2015. <URL: http://www.hotshotsgolf.com/community/showthread.php?t=4652>.*

Hot Shots Golf: Out of Bounds Character Profiles Part 2. IGN.com. Online. Mar. 21, 2008. Accessed via the Internet. Accessed Sep. 18, 2015. <URL: http://www.ign.com/articles/2008/03/12/hot-shots-golf-out-of-bounds-character-profiles-part-2?p.=2>.*

NBC Sports Real Golf. Wikipedia. Online. Accessed via the Internet Accessed Sep. 18, 2015. <URL: https://en.wikipedia.org/wiki/NBC_Sports_Real_Golf>.*

Customer Reivews Tiger Woods PGA Tour 07. Amazonl.com. Online. Accessed via the Internet. Accessed Sep. 18, 2015. <URL: http://www.amazon.com/Tiger-Woods-PGA-Tour-07-PlayStation/product-reviews/B000GPVUK8>.*

Virtual Pool 3 DL Tips. Celeris.com. Online. Feb. 26, 2009. Accessed via the Internet. Accessed Jan. 21, 2016. <URL: http://wayback.archive.org/web/20090226195044/http://celeris.com/games/vp3/tips.html>.*

* cited by examiner

VIRTUAL GOLF SIMULATION APPARATUS PROVIDING PUTTING GUIDE

CROSS REFERENCE TO PRIOR APPLICATIONS

This application is a National Stage Patent Application of PCT International Patent Application No. PCT/KR2010/009553 (filed on Dec. 30, 2010) under 35 U.S.C. §371, which claims priority to Korean Patent Application Nos. 10-2009-0136259 (filed on Dec. 31, 2009) which are all hereby incorporated by reference in their entirety.

TECHNICAL FIELD

The present invention relates to a virtual golf simulation apparatus and method, and, more particularly, to a virtual golf simulation apparatus and method wherein a virtual golf course is imaged and simulated, and the trajectory of a golf ball hit by a user, i.e. a golfer, is simulated in the virtual golf course.

BACKGROUND ART

With the recent upsurge of the golfing population, a so-called screen golf system has gained popularity, which allows a golfer to practice golf and to enjoy a virtual golf game using a virtual golf simulation apparatus.

The screen golf system senses the velocity and direction of a golf ball that a golfer hits onto a screen installed indoors for displaying a virtual golf range, and displays the trajectory of the golf ball on the screen.

The screen golf system implemented using the virtual golf simulation apparatus characteristically offers the same sense of reality that a golfer would feel in a real golf course, when the golfer hits a golf ball in the same manner as in a golf practice range.

It is possible for the virtual golf simulation apparatus to provide various contents based on various kinds of advanced apparatuses and systems, which cannot be provided by a real golf course or a golf practice range. It is necessary for the virtual golf simulation apparatus to simulate a golfer playing a round of golf in a real golf course, thereby providing the same sense of reality that the golfer would feel playing a round of golf in a real golf course and improving golfer convenience.

DISCLOSURE OF INVENTION

Technical Problem

Therefore, it is an object of the present invention to provide a virtual golf simulation apparatus and method that is capable of performing virtual golf simulation as if a golfer is frequently guided by a caddie during a round of golf in a real golf course and, in particular, the caddie reads the lie of a green and guides a putting direction when the golfer putts a golf ball to provide contents provided through the virtual golf simulation in a more active golfer-oriented form, thereby improving user convenience and inducing interest in virtual golf.

Solution to Problem

In accordance with one aspect of the present invention, the above and other objects can be accomplished by the provision of a virtual golf simulation apparatus including an image processing means for displaying an image of a virtual green and topographical information of the virtual green, a simulation means for performing golf simulation on the green, and a putting guide display means for displaying a putting guide which suggests a direction in which a user is to putt the golf ball from the topographical information on all or some of the area between a golf ball and a hole cup on the green in a virtual golf course.

In accordance with another aspect of the present invention, there is provided an apparatus for virtual golf simulation in a golf course including an image processing means for displaying an image of a virtual green and topographical information of the virtual green and a mini map having a downscaled image of the green, a simulation means for performing golf simulation on the green, and a putting guide display means for displaying a putting guide which suggests a direction in which a user is to putt the golf ball on the mini map from the topographical information of the green on all or some of the area between a golf ball and a hole cup on the green in a virtual golf course.

In accordance with another aspect of the present invention, there is provided an apparatus for virtual golf simulation in a golf course including an image processing means for displaying an image of a virtual green and topographical information of the virtual green, a simulation means for performing golf simulation on the green, a caddie processing means for processing information on a virtual caddie who guides virtual golf played by a user, and a putting guide display means for displaying a putting guide which suggests a direction in which the user is to putt the golf ball from the topographical information of the green on all or some of the area between a golf ball and a hole cup on the green in a virtual golf course by the virtual caddie.

In accordance with another aspect of the present invention, there is provided a method for virtual golf simulation in a golf course including displaying a simulation image of a green in a virtual golf course, checking topographical information of the green between a golf ball and a hole cup, and displaying a putting guide for suggesting a direction in which a user is to putt the golf ball over all or some of the area between the golf ball and the hole cup based on the checked topographical information.

In accordance with another aspect of the present invention, there is provided a method for virtual golf simulation in a golf course including displaying a simulation image of a green in a virtual golf course, displaying a mini map having a downscaled image of the green, checking topographical information of the green between a golf ball and a hole cup, and displaying a putting guide for suggesting a direction in which a user is to putt the golf ball over all or some of the area between the golf ball and the hole cup based on the checked topographical information on the mini map.

In accordance with a further aspect of the present invention, there is provided a method for virtual golf simulation in a golf course including displaying a simulation image of a green in a virtual golf course, checking topographical information of the green between a golf ball and a hole cup, extracting voice information and/or image information of a virtual caddie who guides a direction in which a user is to putt the golf ball from a caddie information storage unit, and executing a putting guide for suggesting a direction in which the user is to putt the golf ball based on the checked topographical information through the virtual caddie embodied based on the extracted caddie information.

Advantageous Effects of Invention

In the virtual golf simulation apparatus and method according to the present invention as described above, it is possible to perform virtual golf simulation as if a golfer is frequently guided by a caddie during a round of golf in a real golf course and, in particular, the caddie reads the lie of a green and guides a putting direction when the golfer putts a golf ball to provide contents provided through the virtual golf simulation in a more active golfer-oriented form. Consequently, the present invention has the effect of improving user convenience and inducing interest in virtual golf.

BRIEF DESCRIPTION OF DRAWINGS

The above and other objects, features and other advantages of the present invention will be more clearly understood from the following detailed description taken in conjunction with the accompanying drawings, in which.

BEST MODE FOR CARRYING OUT THE INVENTION

Now, exemplary embodiments of a virtual golf simulation apparatus according to the present invention will be described in detail with reference to the accompanying drawings.

The virtual golf simulation apparatus according to the present invention may be embodied in various forms. Typically, the virtual golf simulation apparatus according to the present invention may be applied to a so-called screen golf system.

Figure 1:
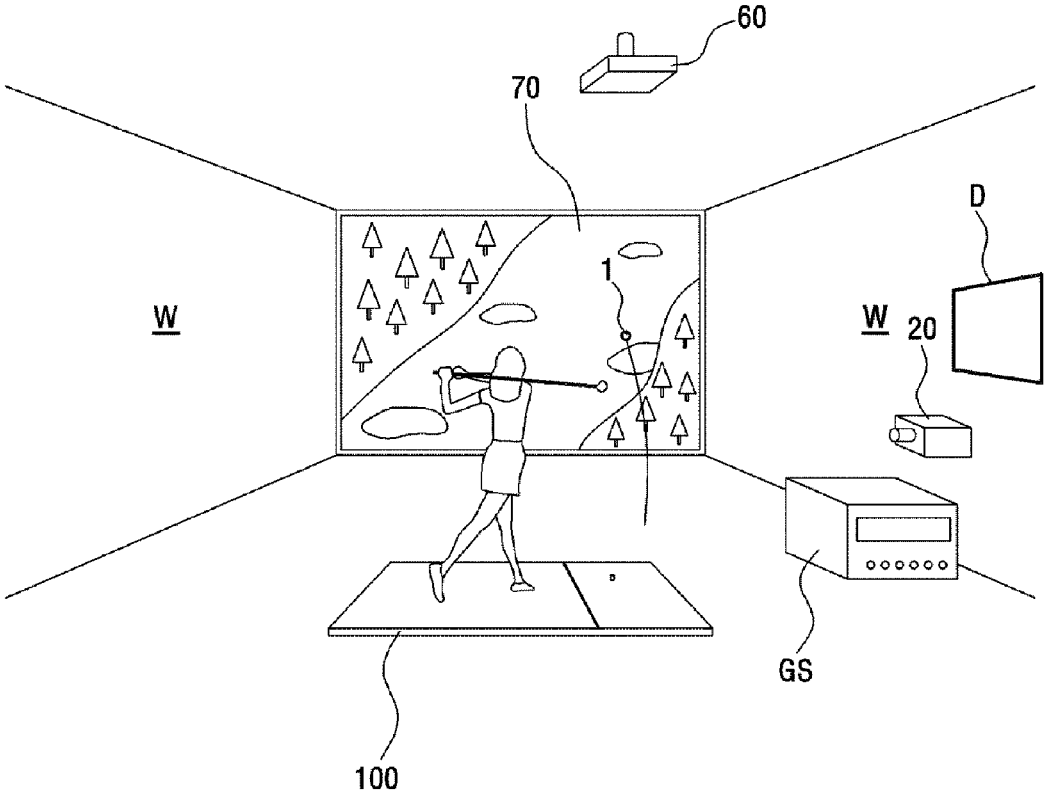
FIG. 1 is a view illustrating a screen golf system to which a virtual golf simulation apparatus according to an embodiment of the present invention is applied.
Figure 2:
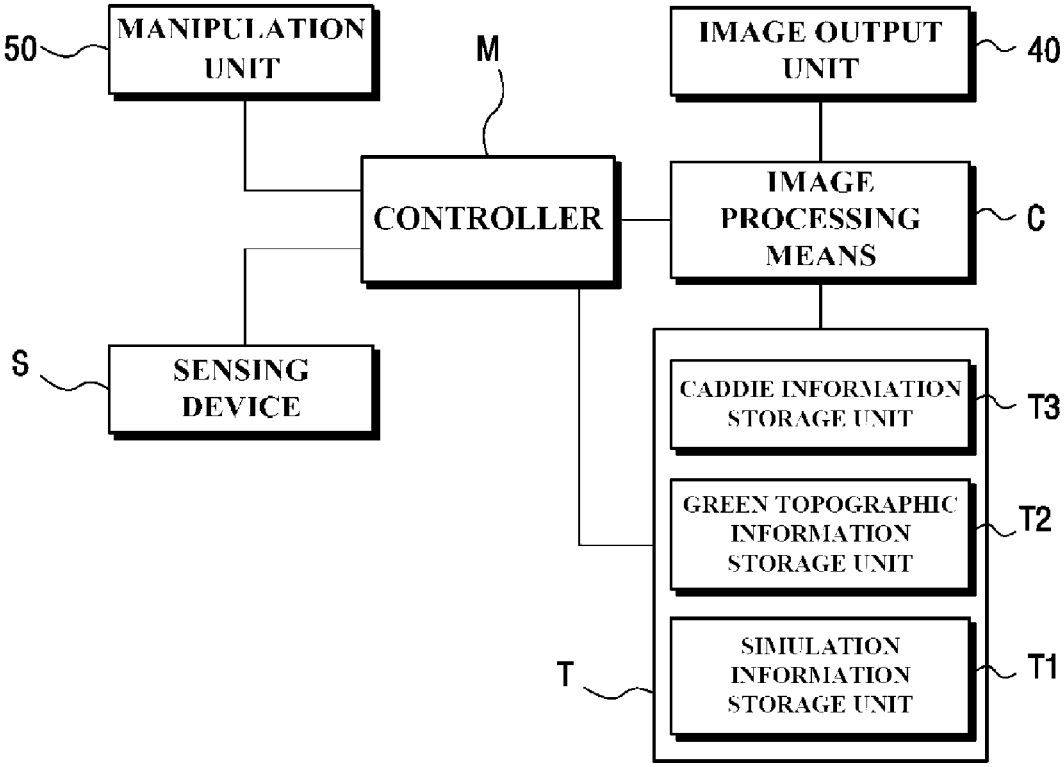
FIG. 2 is a block diagram illustrating a control system of a virtual golf simulation apparatus according to an embodiment of the present invention.

FIGS. 1 and 2 illustrate an example in which a virtual golf simulation apparatus according to the present invention is applied to a screen golf system, to which, however, the present invention is not limited. For example, the present invention may be applied to all kinds of systems and/or apparatuses that are capable of simulating and imaging a virtual golf course and simulating a virtual golf ball image.

Hereinafter, an example in which a virtual golf simulation apparatus and method according to the present invention are applied to a screen golf system will be described with reference to FIGS. 1 to 2.

As shown in FIGS. 1 and 2, a virtual golf simulation apparatus according to an embodiment of the present invention includes a sensing device S for sensing a golf swing performed by a golfer and/or the behavior of a golf ball B hit by the golfer, an image output unit 40 for outputting a predetermined image to a screen 30 disposed in front of the image output unit 40, and a simulation means, i.e. a simulator 20, for storing and processing all data necessary for virtual golf simulation.

Also, the virtual golf simulation apparatus according to this embodiment of the present invention further includes a manipulation unit for allowing a golfer to manipulate a system setting or various kinds of settings necessary to perform a virtual golf game.

FIG. 1 illustrates a keyboard and mouse set 50 as an example of the manipulation unit. A touch screen 70 mounted at a side wall W of a booth may be provided as an example of the manipulation unit.

Also, although not shown, a remote control (not shown) may be provided as the manipulation unit so that the remote control can directly communicate with the simulator or the touch screen to manipulate virtual golf simulation.

It may be inconvenient for a golfer standing on a swing plate 10 to manipulate the keyboard and mouse set 50 or the touch screen 70 shown in FIG. 1. For this reason, it may be possible to provide a key manipulation unit (not shown) disposed at the swing plate 10 for allowing a golfer who is ready to swing on the swing plate 10 to conveniently manipulate settings for virtual golf simulation as an example of the manipulation unit.

Also, a camera 60 may be mounted to the side wall W of the booth to capture swings of a golfer, as shown in FIG. 1.

Meanwhile, the simulator 20 may include an image processing means C, a storage unit T and a controller M.

The storage unit T stores all data necessary for virtual golf simulation including data on a virtual golf course. The image processing means C is provided to process all images related to virtual golf simulation, such as images related to a virtual golf course, images related to movement of a golf ball, and images for menu selection, as data stored in the storage unit T.

The controller M is provided to perform various calculations for virtual golf simulation and to control components of the virtual golf simulation apparatus.

That is, when a golfer hits a golf ball on the swing plate 10 to the screen 30, the sensing device S senses the shot of the golf ball, and transmits the sensing result to the controller M. The controller M transmits the sensing result to the image processing means C. The image processing means C extracts golf simulation image information, such as a movement image of the golf ball, from the storage unit T in consideration of movement properties of the golf ball. The golf simulation image information is projected on the screen 30 through the image output unit 40 so that a golf game through virtual simulation is performed.

Although not clearly shown in FIG. 1, the sensing device S (see FIG. 2) may be embodied by an infrared light transmitting and receiving sensor mounted at the swing plate 10 or a camera sensor mounted at the ceiling or the wall. In addition, the sensing device S may be embodied by other different sensors.

Meanwhile, as shown in FIG. 2, the storage unit T of the virtual golf simulation apparatus according to the present invention may include a simulation information storage unit T1 for storing all data for virtual golf simulation, a green topographical information storage unit T2 for storing green topographical information necessary for putting, and a caddie information storage unit T3 for storing information on virtual caddies.

Here, the simulation information storage unit T1, the green topographical information storage unit T2, and the caddie information storage unit T3 may have independent storage spaces for storing data. Alternatively, the simulation information storage unit T1, the green topographical information storage unit T2, and the caddie information storage unit T3 may store data in separate physical sections of a single storage space.

The caddie information storage unit T3 may store a specific voice and/or image so that a guide to a virtual golf game can be executed by a virtual caddie during virtual golf simulation. In particular, the caddie information storage unit T3 may store information necessary to guide a putting direction during putting.

The virtual golf simulation apparatus according to the present invention is characterized in that the virtual golf simulation apparatus provides a putting guide which basically reads the lie of a green during putting to suggest a putting direction.

That is, the virtual golf simulation apparatus according to the present invention further includes a putting guide display means for displaying a putting guide which suggests a direction in which a user is to putt the golf ball from topographical information on all or some of the area between a golf ball and a hole cup on a green in a virtual golf course.

In addition, the virtual golf simulation apparatus according to the present invention further includes a caddie processing means for processing information on a virtual caddie who guides virtual golf played by a user. The virtual caddie executes the putting guide to provide the same sense of reality that a golfer would feel playing a round of golf in a real golf course while being guided by a real caddie.

For example, when the putting guide is displayed, the controller extracts information on a specific virtual caddie from the caddie information storage unit T3 and outputs the extracted information together with image and/or voice information so that the virtual caddie can guide a putting direction.

Hereinafter, examples of the putting guide provided by the virtual golf simulation apparatus according to the present invention will be described in detail with reference to FIGS. 3 to 6.

First, a putting guide provided by a virtual golf simulation apparatus according to an embodiment of the present invention will be described with reference to FIGS. 3 and 4.

Figure 3:
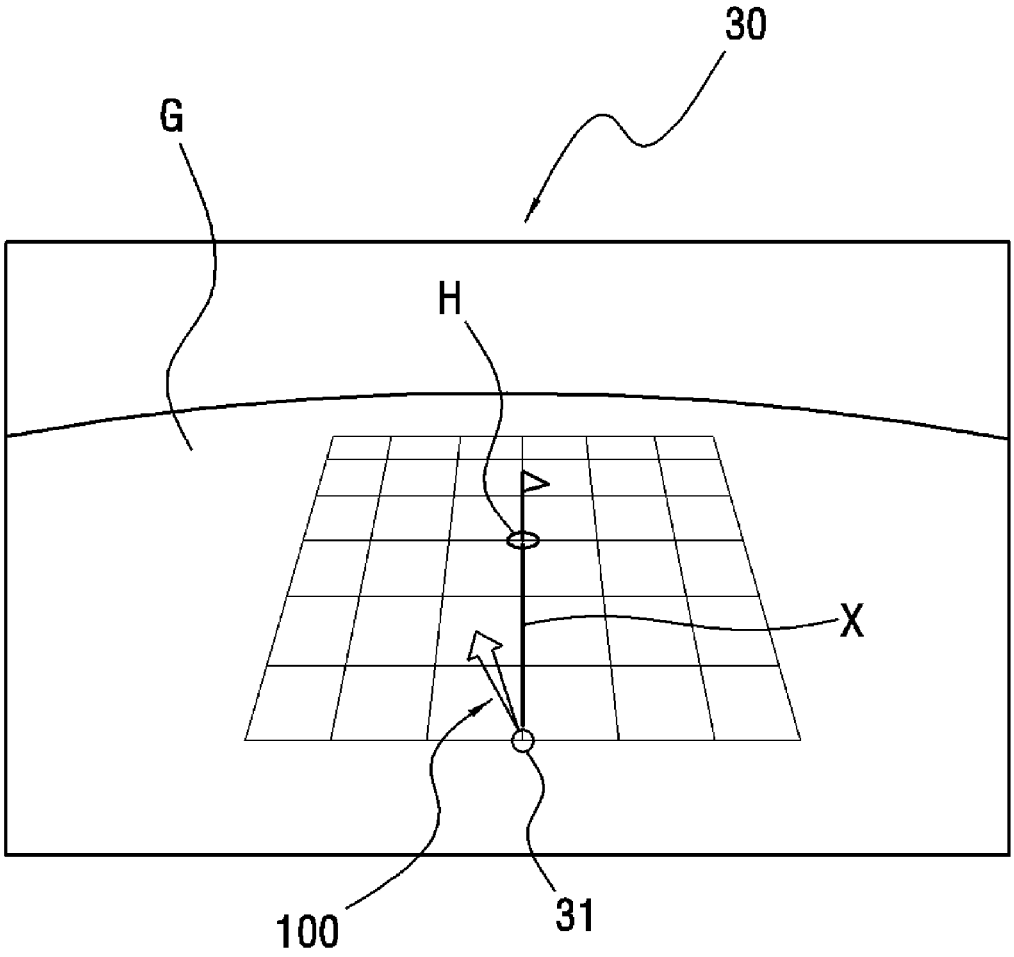
FIGS. 3 and 4 are views illustrating an example of a putting guide provided by the virtual golf simulation apparatus according to the present invention.
Figure 4:
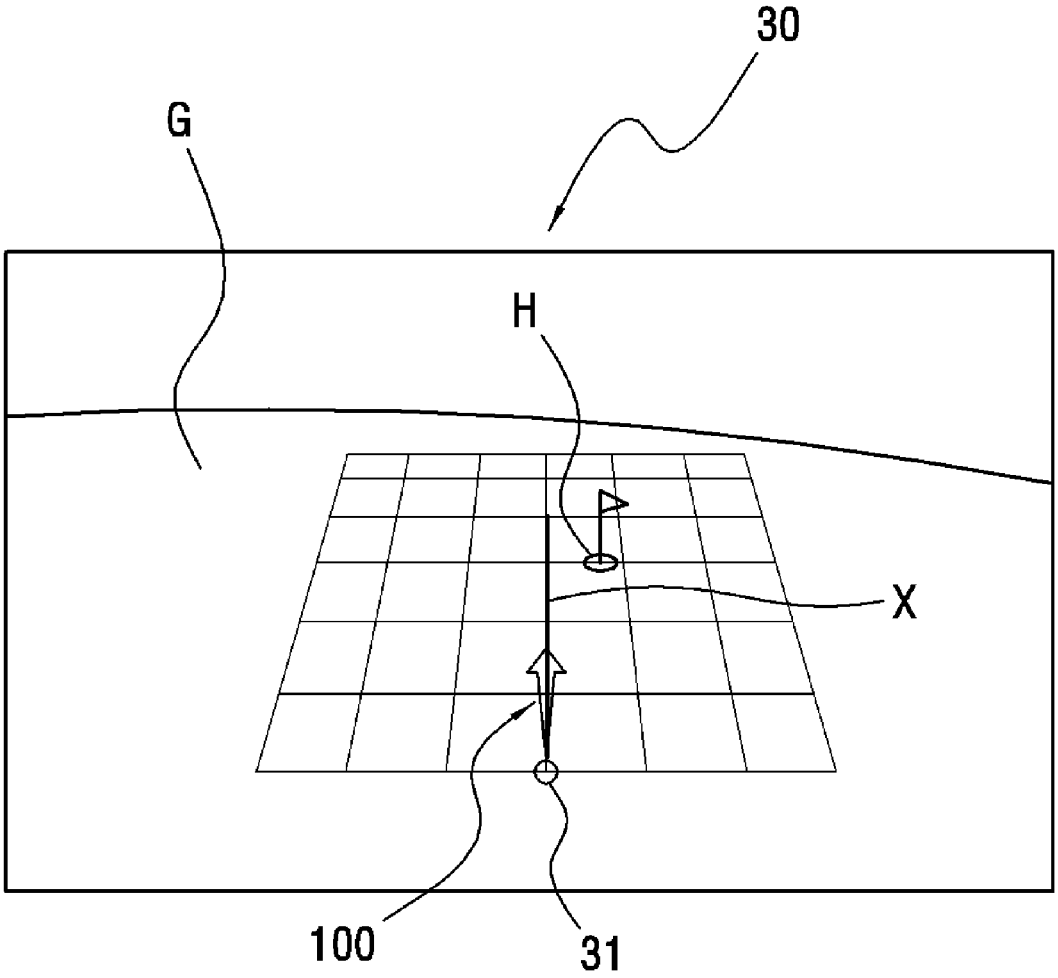

FIGS. 3 and 4 are views illustrating an example in which an image output from a virtual golf simulation apparatus according to an embodiment of the present invention is displayed on a screen 30.

As shown in FIG. 3, a putting guide 100 is displayed on a green G between a golf ball 31 and a hole cup H. Preferably, the putting guide 100 is configured in the form of an arrow for guiding a putting direction. In FIG. 3, reference symbol X indicates a guide line for guiding an advancing direction of the golf ball 31.

That is, when the golf ball 31 is to be putted on the green G, the simulation means, i.e. the simulator, reads a topographical property, i.e. the lie of a green, between the golf ball 31 and the hole cup to display a putting direction in the form of an arrow.

At this time, the putting guide 100 may be displayed through user, i.e., golfer, manipulation using the manipulation unit. Alternatively, the putting guide 100 may be set to be automatically displayed when the golf ball is to be putted a predetermined distance from the hole cup H.

Also, as shown in FIG. 4, aiming may be performed. Aiming is for a golfer to manipulate the guide line X so that the guide line X and the arrow of the putting guide 100 are arranged in the same straight line. When the golfer putts the golf ball frontward, therefore, the putting is performed according to the lie of the green.

The aiming may be performed through golfer manipulation using the manipulation unit. Alternatively, the aiming may be automatically performed by the simulator. The golfer may putt the golf ball according to the putting guide. On the other hand, the golfer may putt the golf ball without dependence on the putting guide. Preferably, therefore, the aiming is manually performed through golfer manipulation.

The arrow of the putting guide 100 may be displayed over all of the area between the golf ball 31 and the hole cup H. Preferably, however, the arrow of the putting guide 100 is displayed over some of the area between the golf ball 31 and the hole cup H, as shown in FIGS. 3 and 4. That is, it is preferable that the length of the arrow is less than the distance between the golf ball 31 and the hole cup H.

Hereinafter, a putting guide provided by a virtual golf simulation apparatus according to another embodiment of the present invention will be described with reference to FIGS. 5 and 6.

Figure 5:
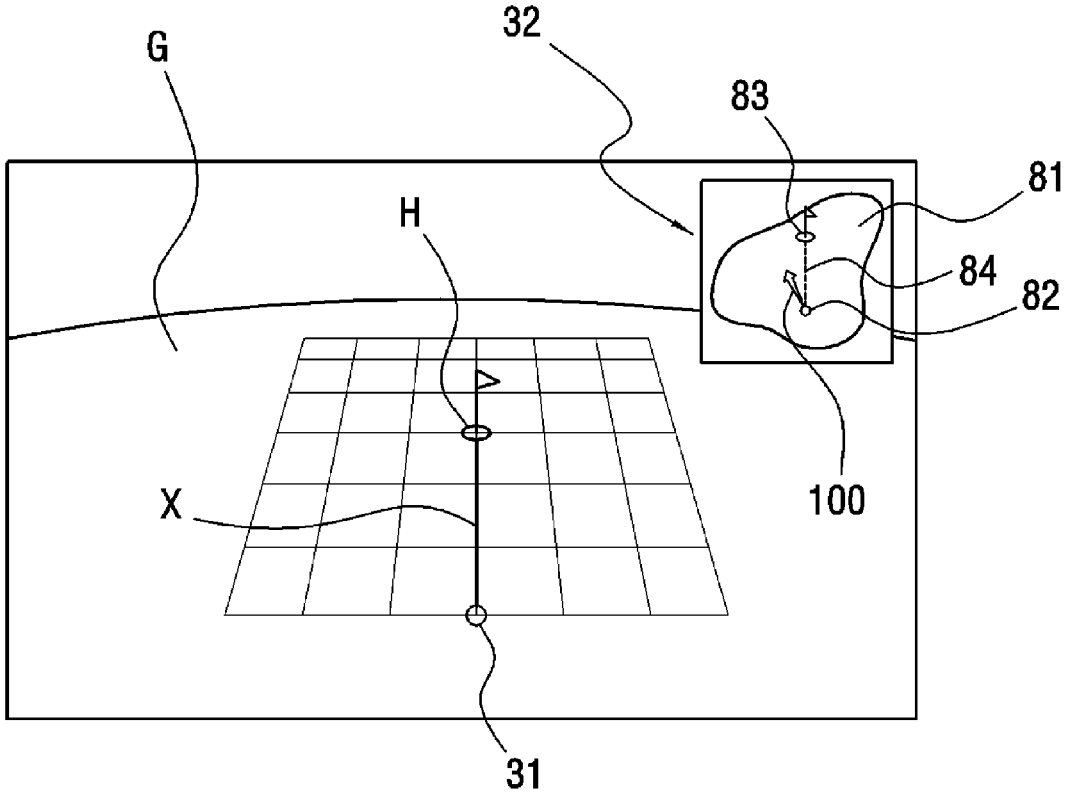
FIGS. 5 and 6 are views illustrating another example of the putting guide provided by the virtual golf simulation apparatus according to the present invention.
Figure 6:
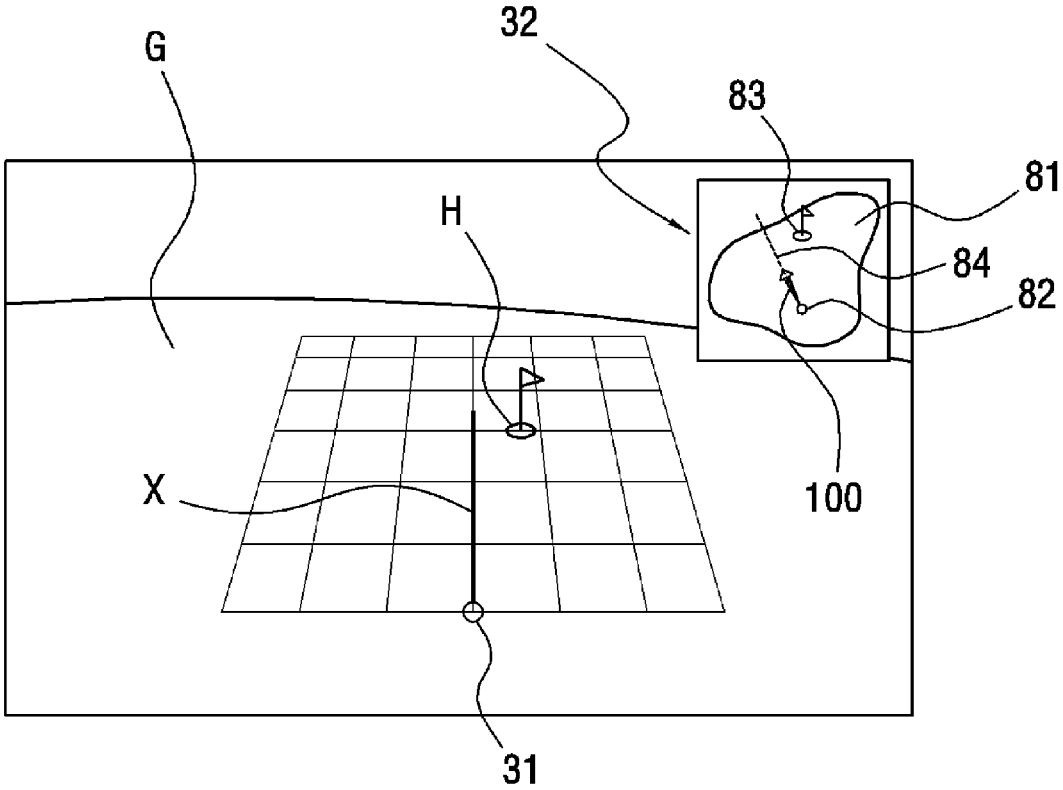

FIGS. 5 and 6 are views illustrating an example in which an image output from a virtual golf simulation apparatus according to another embodiment of the present invention is displayed on a screen 30. As shown in FIGS. 5 and 6, an image of a mini map 32 may be further displayed on the screen with a main image.

A downscaled image of all or some of a green on which a virtual golf game is being currently played and information on the state of the green may be displayed on the mini map 32 so that the downscaled image and the state information can be recognized at a glance. For example, positions of a hole cup 83 and a golf ball 82 on a green 81 may be displayed on the mini map 32 so that the positions of the hole cup 83 and the golf ball 82 on the green 81 can be recognized at a glance. Also, although not shown, green topographical information may be displayed on the mini map 32 so that the green topographical information can be recognized at a glance.

The virtual golf simulation apparatus according to the embodiment of the present invention as shown in FIGS. 5 and 6 is characterized in that the putting guide 100 is displayed on the mini map 32.

That is, upon putting of the golf ball, it is possible to read the topographical information of all or some of the area between the golf balls 31 and 82 and the corresponding holes cup H and 83 through golfer manipulation or automatically and to display the putting guide 100 on the mini map 32 according to the topographical information.

Meanwhile, in a case in which aiming is performed after the putting guide 100 is displayed, the aiming may be performed according to the direction indicated by the putting guide 100, as shown in FIG. 6.

That is, as shown in FIG. 6, a golfer may manipulate guide lines (reference symbol X indicates a guide line on the main image, and reference numeral 84 indicates a guide line on the mini map 32) so that the guide lines coincide with the putting guide 100, thereby performing the aiming. Alternatively, the guide lines X and 84 may automatically coincide with the putting guide 100.

At this time, it is preferable that the aiming is performed on the main image in the same manner while the aiming is performed on the mini map 32.

The arrow of the putting guide 100 may be displayed over all of the area between the golf ball 82 and the hole cup 83. Preferably, however, the arrow of the putting guide 100 is displayed over some of the area between the golf ball 82 and the hole cup 83, as shown in FIGS. 5 and 6. That is, it is preferable that the length of the arrow is less than the distance between the golf ball 82 and the hole cup 83.

Meanwhile, although not shown, the putting guide may be suggested by a virtual caddie in the virtual golf simulation apparatus according to this embodiment of the present invention.

Information, i.e. voice information, character information or image information, on a virtual caddie is loaded to the controller from the caddie information storage unit T3 (see FIG. 2) of the storage unit of the virtual golf simulation apparatus so that the putting guide (including all of the putting guides according to the respective embodiments of the present invention as shown in FIGS. 3 to 6) can be suggested according to the properties of the loaded virtual caddie.

Also, the respective virtual caddies may be embodied to have various characters. Consequently, it is possible for a golfer to select one of the various characters of the virtual caddies so that the golfer can be guided by the virtual caddie having the selected character during a virtual golf game.

At this time, the putting guide may be created by the virtual caddie selected by the golfer upon putting of the golf ball. If the respective virtual caddies are set to have different ability values, the putting guide may be executed with different accuracy based on the ability value of the selected virtual caddie.

For example, the characters of the respective virtual caddies may be classified based on sex, age, caddie career, golfer career, and average score of the golf, and contribution of the respective items to accuracy of the putting guide may be preset. For the respective virtual caddies, the values of the respective items may be set to be different from each other so that accuracy of the putting guide is changed for the respective virtual caddies.

In this way, the putting guide is executed by the virtual caddie, and therefore it is possible for a golfer to have much more interest through the virtual golf simulation than when the golfer enjoys a golf game in a real golf course.

Hereinafter, execution flows of the putting guides provided by the virtual golf simulation apparatus according to the present invention will be described in detail with reference to FIGS. 7 and 8.

Figure 7:
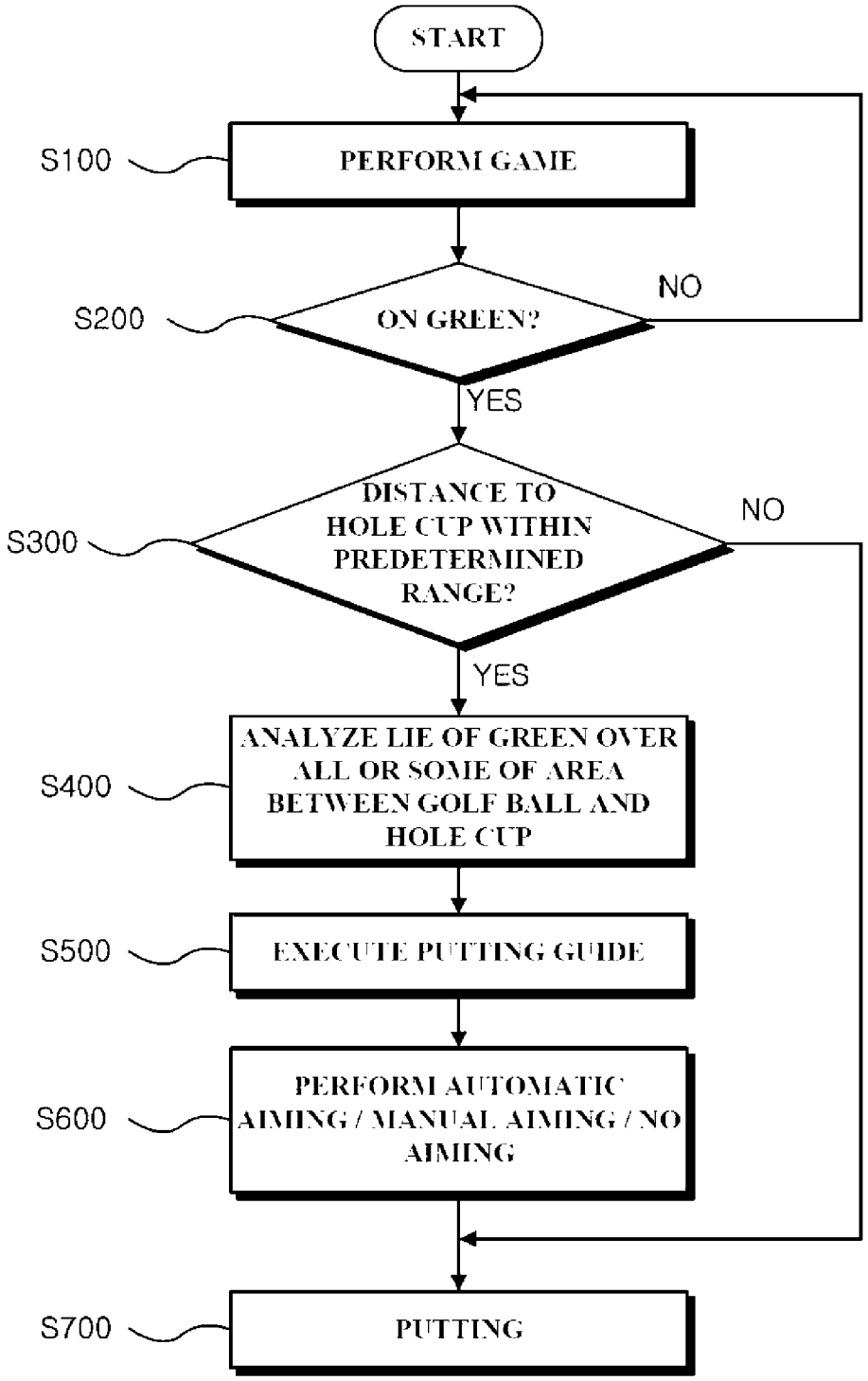
FIGS. 7 and 8 are flow charts related to the putting guides provided by the virtual golf simulation apparatus according to the present invention.
Figure 8:
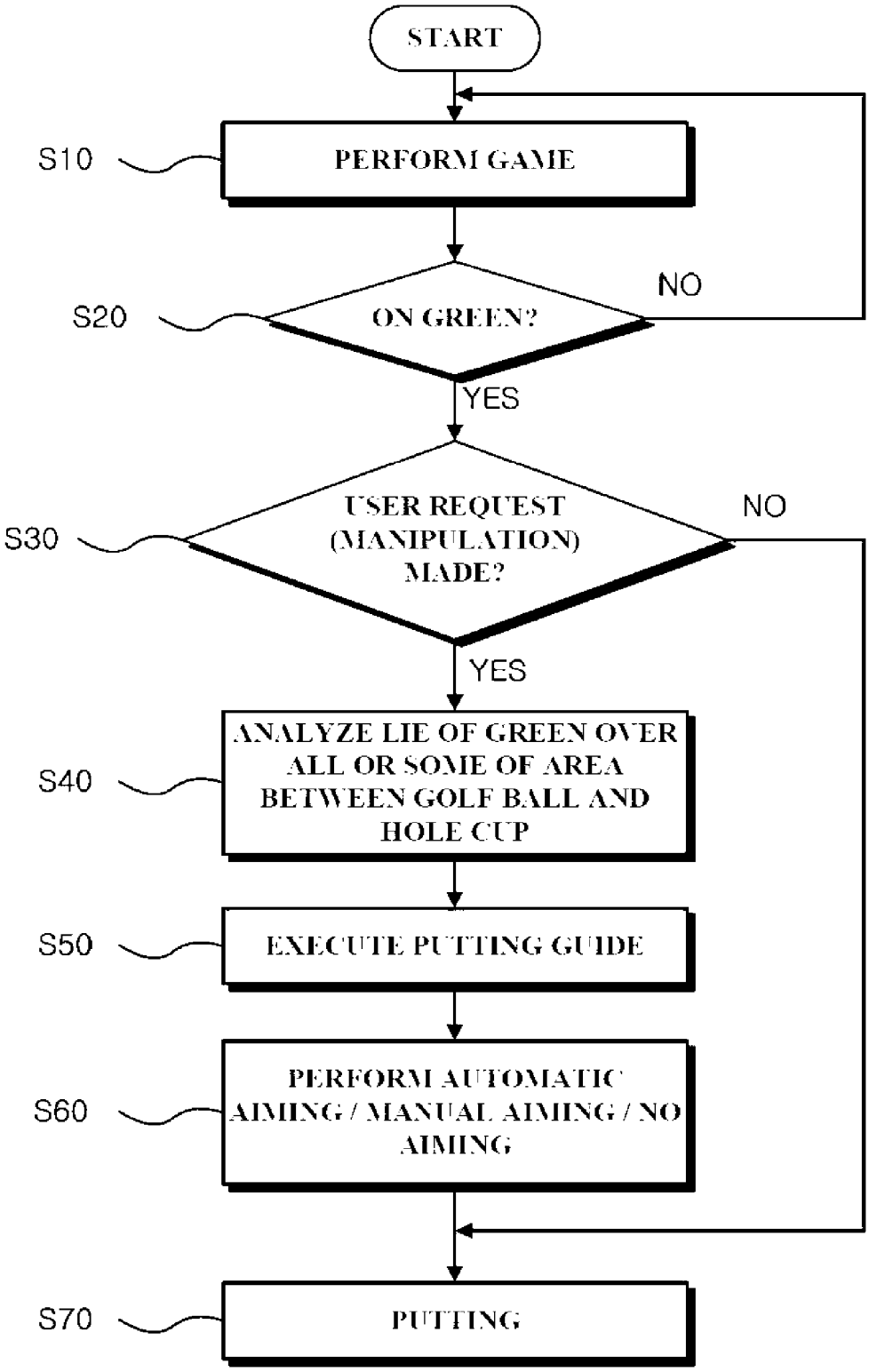

The flow chart of FIG. 7 illustrates that the putting guide is automatically executed according to a specific condition, and the flow chart of FIG. 8 illustrates that the putting guide is manually executed through golfer manipulation.

As shown in FIG. 7, a virtual golf game is performed (S100), and, upon determining as the result of virtual golf simulation that a golf ball has duly reached a green (S200), the controller determines whether the distance from the golf ball to a hole cup is within a predetermined range (S300).

Upon determining that the golf ball is located within the predetermined range, the simulator analyzes the lie of a green over all or some of the area between the golf ball and the hole cup (S400).

Subsequently, a putting guide is executed (S500), and putting of the golf ball is performed through automatic aiming performed by the simulator, through manual aiming manipulated by a golfer, or without aiming (S600 and S700).

On the other hand, as shown in FIG. 8, a virtual golf game is performed (S10), and, upon determining as the result of virtual golf simulation that a golf ball has duly reached a green (S20), the controller determines whether a golfer has requested execution of a putting guide using the manipulation unit (S30).

Upon determining that the golfer has requested the execution of the putting guide, the simulator analyzes the lie of a green over all or some of the area between the golf ball and a hole cup (S40).

Subsequently, a putting guide is executed (S50), and putting of the golf ball is performed through automatic aiming performed by the simulator, through manual aiming manipulated by the golfer, or without aiming (S60 and S70).

MODE FOR THE INVENTION

Various embodiments of an apparatus and method for the virtual golf simulation have been described in the best mode for carrying out the invention.

INDUSTRIAL APPLICABILITY

In the apparatus and method for the virtual golf simulation according to the present invention as described above, it is possible to perform virtual golf simulation as if a golfer is frequently guided by a caddie during a round of golf in a real golf course and, in particular, the caddie reads the lie of a green and guides a putting direction when the golfer putts a golf ball to provide contents provided through the virtual golf simulation in a more active golfer-oriented form, thereby improving user convenience and inducing interest in virtual golf. Consequently, the present invention can be widely used in industries related to the apparatus and method for the virtual golf simulation.

The invention claimed is:

1. A virtual golf simulation apparatus for a user to play golf on a virtual golf course realized by imaging processing, comprising:

a sensing device which senses a golf ball putted by the user;

an image processing means configured to display an image of a virtual green and a virtual golf ball, and green topographical information of the virtual green on at least one of a display and a screen;

a green topographical information storage unit which stores therein the green topographical information necessary for a putting of the user on the virtual green; and a controller configured to read a putting green between the virtual golf ball and a hole cup on the virtual green from the green topographical information and control the image processing means to display a movement of the virtual golf ball on the virtual green based on a reading of the putting green and a result of a sensing of the golf ball by the sensing device, wherein the controller is further configured to control the image processing means to display:

a guide line showing a straight line formed from the virtual ball toward a frontward direction on the displayed virtual green, and a putting guide, on the virtual green, which indicates a direction where the user is to aim and putt the golf ball to put the virtual golf ball into the hole cup, based on a result of the reading of the putting green by the controller, wherein the controller is further configured to control the image processing means to i) arrange the virtual ball, the hole cup, and the guide line in a line on the virtual green, then ii) arrange the guide line and the putting guide in a same direction, then iii) shift the hole cup from an area on the guide line to other area on the virtual green, and then iv) display the virtual golf ball corresponding to the golf ball putted frontward along the guide line with no adjustments by the user to move along the direction indicated by the putting guide toward the hole cup.

2. The virtual golf simulation apparatus according to claim 1, wherein the image processing means is configured to display a main image for the virtual green and a mini map having a downscaled image of the virtual green, and to display the guide line on the main image, and a mini map guide line and the putting guide on the mini map, wherein the image processing means is further configured to display a mini map virtual ball, a mini map hole cup, and the mini map guide line in a line on the mini map and to display the putting guide on the mini map to indicate the direction where the user is to aim, when the virtual ball, the hole cup, and the guide line are arranged in a line on the virtual green of the main image, wherein the image processing means is further configured to display the mini map guide line to change a direction and overlap with the putting guide which indicates the direction where the user is to aim on the mini map when the hole cup is shifted from the area on the guide line to the other area on virtual green of the main image.

3. The virtual golf simulation apparatus according to claim 1, further comprising a caddie processing means for processing information on a virtual caddie who guides virtual golf played by the user, wherein the image processing means is configured to display the putting guide by the virtual caddie implemented by the caddie processing means.

4. The virtual golf simulation apparatus according to claim 3, wherein the caddie processing means stores information on a plurality of virtual caddies, and the putting guide is displayed by one, selected by the user or randomly selected, of the virtual caddies.

5. The virtual golf simulation apparatus according to claim 4, wherein the virtual caddies have different ability values, respectively, so that different accuracies of the putting guide are set for the respective caddies.

6. The virtual golf simulation apparatus according to claim 1, wherein the putting guide is selectively executed through user manipulation or is automatically executed according to a specific condition.

7. The virtual golf simulation apparatus according to claim 1, wherein the putting guide comprises an arrow for guiding the direction where the user is to aim and putt the golf ball.

8. The virtual golf simulation apparatus according to claim 1, wherein the putting guide comprises an arrow displayed over some of the area between the golf ball and the hole cup for guiding the direction where the user is to aim and putt the golf ball.

9. The virtual golf simulation apparatus according to claim 1, wherein the putting guide is selectively executed through user manipulation or is automatically executed when the golf ball enters an area having a predetermined radius about the hole cup.

10. A method for virtual golf simulation for a user to play golf on a virtual golf course realized by imaging processing, the method comprising:

extracting by a controller green topographical information of a virtual green from a green topographical information storage unit;

displaying, by a image processing means controlled by the controller on the virtual green displayed on at least one of a display and a screen, a guide line showing a straight line formed from a virtual ball toward a frontward direction on the displayed virtual green;

reading by the controller a putting green between the virtual golf ball and a hole cup on the virtual green from the green topographical information necessary for a putting of the user on the virtual golf;

displaying by the image processing means controlled by the controller on the virtual green a putting guide which indicates a direction where the user is to aim and putt the golf ball to put the virtual golf ball into the hole cup, based on a result of said reading the putting green by the controller;

arranging, by the image processing means controlled by the controller, the virtual ball, the hole cup, and the guide line in a line on the virtual green;

arranging, by the image processing means controlled by the controller, the guide line and the putting guide in a same direction;

shifting, by the image processing means controlled by the controller, the hole cup from an area on the guide line to other area on the virtual green; and displaying, by the image processing means controlled by the controller, the virtual golf ball corresponding to the golf ball putted frontward along the guide line with no adjustments by the user to move along the direction indicated by the putting guide toward the hole cup.

11. The virtual golf simulation method according to claim 10, further comprising;

displaying on at least one of the display and the screen a main image for the virtual green and a mini map having a downscaled image of the virtual green, wherein the guide line is displayed on the main image, and a mini map guide line and the putting guide are displayed on the mini map;

displaying a mini map virtual ball, a mini map hole cup, and the mini map guide line in a line on the mini map and displaying the putting guide on the mini map to indicate the direction where the user is to aim, when the virtual ball, the hole cup, and the guide line are arranged in a line on the virtual green of the main image; and displaying the mini map guide line to change a direction and overlap with the putting guide which indicates the direction where the user is to aim on the mini map, when the hole cup is shifted from the area on the guide line to the other area on virtual green of the main image.

12. The virtual golf simulation method according to claim 10, further comprising:

determining whether the virtual golf ball has entered an area having a predetermined radius about the hole cup on the virtual green, when the virtual golf ball has entered the area having the predetermined radius about the hole cup, the step of reading the putting green and the step of displaying the putting guide are automatically performed.

13. A method for virtual golf simulation for a user to play golf on a virtual golf course realized by imaging processing, the method comprising:

extracting by a controller green topographical information of a virtual green from a green topographical information storage unit;

displaying, by a image processing means controlled by the controller on the virtual green displayed on at least one of a display and a screen, a guide line showing a straight line formed from a virtual ball toward a frontward direction on the displayed virtual green;

reading by the controller a putting green between the virtual golf ball and a hole cup on the virtual green from the green topographical information necessary for a putting of the user on the virtual golf;

extracting at least one of voice information and image information of a virtual caddie who guides a direction where a user is to aim and putt the golf ball to put the virtual golf ball into the hole cup based on a result of said reading the putting green by the controller, from a caddie information storage unit;

displaying a putting guide, on the virtual green, which indicates the direction where the user is to aim and putt the golf ball to put the virtual golf ball into the hole cup, through the virtual caddie embodied based on the extracted caddie information;

arranging, by the image processing means controlled by the controller, the virtual ball, the hole cup, and the guide line in a line on the virtual green;

arranging, by the image processing means controlled by the controller, the guide line and the putting guide in a same direction;

shifting, by the image processing means controlled by the controller, the hole cup from an area on the guide line to other area on the virtual green; and displaying, by the image processing means controlled by the controller, the virtual golf ball corresponding to the golf ball putted frontward along the guide line with no adjustments by the user to move along the direction indicated by the putting guide toward the hole cup.

14. The virtual golf simulation method according to claim 13, wherein the caddie information storage unit stores a plurality of virtual caddies having different kinds of voice and image information, and the step of extracting at least one of voice information and image information of the virtual caddie comprises extracting information on a specific one, selected by the user or randomly selected, of the virtual caddies from the caddie information storage unit.

15. The virtual golf simulation method according to claim 13, wherein the caddie information storage unit stores a plurality of virtual caddies having information on different ability values, the step of extracting at least one of voice information and image information of the virtual caddie comprises extracting information on a specific one, selected by the user or randomly selected, of the virtual caddies from the caddie information storage unit, and the step of displaying the putting guide comprises executing the putting guide with accuracy corresponding to an ability value of the selected virtual caddie.

16. The virtual golf simulation method according to claim 13, further comprising:

displaying on at least one of the display and the screen a main image for the virtual green and a mini map having a downscaled image of the virtual green, wherein the guide line is displayed on the main image, and a mini map guide line and the putting guide are displayed on the mini map;

displaying a mini map virtual ball, a mini map hole cup, and the mini map guide line in a line on the mini map and displaying the putting guide on the mini map to indicate the direction where the user is to aim, when the virtual ball, the hole cup, and the guide line are arranged in a line on the virtual green of the main image; and displaying the mini map guide line to change a direction and overlap with the putting guide which indicates the direction where the user is to aim on the mini map, when the hole cup is shifted from the area on the guide line to the other area on virtual green of the main image.

* * * * *